United States Patent [19]

Hashiyama et al.

[11] Patent Number: 4,993,370

[45] Date of Patent: Feb. 19, 1991

[54] VALVE DRIVING MECHANISM FOR INTERNAL COMBUSTION ENGINE

[75] Inventors: Kouichi Hashiyama, Hiroshima; Junichi Okita, Iwakuni; Kouichi Hatamura, Hiroshima; Ryoji Abe, Hiroshima; Noriyuki Iwata, Hiroshima, all of Japan

[73] Assignee: Mazda Motor Corporation, Hiroshima, Japan

[21] Appl. No.: 427,471

[22] Filed: Oct. 27, 1989

[30] Foreign Application Priority Data

Oct. 29, 1988 [JP] Japan ..... 63-274258
Oct. 29, 1988 [JP] Japan ..... 63-274259

[51] Int. Cl.[5] ..... F01L 1/34
[52] U.S. Cl. ..... 123/90.17; 123/90.31
[58] Field of Search ..... 123/90.12, 90.13, 90.15, 123/90.17, 90.31

[56] References Cited

U.S. PATENT DOCUMENTS 4,231,330 11/1980 Garcea ..... 123/90.15
4,421,074 12/1983 Garcea et al. ..... 123/90.15
4,535,731 8/1985 Banfi ..... 123/90.17
4,658,769 4/1987 Horio et al. ..... 123/90.31
4,674,452 6/1987 Asanomi ..... 123/90.31
4,805,566 2/1989 Ampferer ..... 123/90.31
4,811,698 3/1989 Akasaka et al. ..... 123/90.17
4,862,843 9/1989 Kawamoto et al. ..... 123/90.13

FOREIGN PATENT DOCUMENTS 3243682 8/1983 Fed. Rep. of Germany ... 123/90.31
60-153411 8/1985 Japan .
63-230917 9/1988 Japan .
2152193 7/1985 United Kingdom ..... 123/90.17

*Primary Examiner*—Charles J. Myhre
*Assistant Examiner*—Weilun Lo
*Attorney, Agent, or Firm*—Fleit, Jacobson, Cohn, Price, Holman & Stern

[57] ABSTRACT

A valve driving mechanism includes a pair of cam shafts for driving either an intake valve or an exhaust valve, and a power transmitting device provided on said first cam shaft for driving the cam shafts. A phase varying device of annular configuration is provided between the cam shaft and the power transmitting device for varying a relative rotation phase between the cam shaft and the power transmitting device so that a compact valve timing control can be provided.

19 Claims, 7 Drawing Sheets

VALVE DRIVING MECHANISM FOR INTERNAL COMBUSTION ENGINE

BACKGROUND OF THE INVENTION

1. Field of the invention

The present invention relates to a valve driving mechanism for internal combustion engine, more specifically to a cam shaft control mechanism therefor.

2. Description of the prior art

There has been known an engine provided with a double over head cam (DOHC) type valve driving mechanism for driving intake and exhaust valves disposed over a cylinder head by means of a pair of cam shafts also disposed over the cylinder head. For instance, Japanese Utility Model Public Disclosure No. 61-9501, laid open to the public in 1986, discloses a valve driving mechanism in which one of over head cam shafts is provided with a driving sprocket or driving pulley in case of timing belt and the other of the cam shafts is connected with the one of the cam shafts through a gear mechanism so that driving force is transmitted from the one to the other of the came shafts through the gear mechanism.

This type of valve driving mechanism is advantageous in that a compact mechanism can be obtained.

In the valve driving mechanism, there has been proposed a valve timing varying system which is effected to vary opening and closing timing and thus, an overlap period of valve opening in accordance with engine operating condition so as to improve engine output property.

Japanese Patent Public Disclosure (KOKAI) No. 60-240809, laid open to the public on Nov. 29, 1985, U.S. Pat. No. 4,535,731 issued on Aug. 20, 1985 and U.S. Pat. No. 4,674,452 disclose various valve timing varying systems of the valve driving mechanism.

In varying the valve timing, there has been proposed providing a rotation phase changing device for changing a rotation phase between intake and exhaust cam shafts wherein the rotation phase changing device is constituted by a mechanism as utilizing helical splines arranged between the driving pulley connected with a crank shaft and the cam shaft.

It should however be noted that in the valve driving mechanism in which a driving force is transmitted from one to the other of the cam shafts through a gear mechanism disposed therebetween, the rotation phase of the cam shafts relative to each other cannot be changed and therefore, the overlap period of the valve opening cannot be controlled.

Other valve timing varying systems tends to be complicated in mechanism.

SUMMARY OF THE INVENTION

It is therefore an object of the present invention to provide a compact valve timing control system for a valve driving mechanism.

It is another object of the present invention to provide a compact valve driving mechanism which can vary an overlap period of intake and exhaust valve opening.

It is still another object of the present invention to provide a valve driving mechanism which can vary a relative rotation phase of both intake cam shaft and exhaust cam shaft.

The above and other objects of the present invention can be accomplished by a valve driving mechanism comprising a first cam shaft for driving either one of intake valve or exhaust valve, a second cam shaft for driving the other of the intake valve and the exhaust valve, first power transmitting device for driving said first cam shaft, second power transmitting device for driving said second cam shaft, phase varying device for varying a relative rotation phase provided either between said first power transmitting device and said first cam shaft or between said first power transmitting device and the said second power transmitting device, said first power transmitting device being connected with one of said first cam shaft and said second power transmitting device not intervened by said phase varying device to keep a constant phasic relationship with each other, said first cam shaft being independent from said second power transmitting device in operation.

According to the present invention, an engine power or rotation force is transmitted to the first cam shaft through the first transmitting device. Rotation of the first power transmitting device is transmitted to the second cam shaft through the second power transmitting device. A rotation phase of one of the first cam shaft and the second power transmitting device is changed by virtue of the phase varying device relative to the first power transmitting device. The other of the first cam shaft and the second power transmitting device not intervened by the phase varying device rotates with the first power transmitting device with a stationary phase. The first cam shaft is free from the second power transmitting device, thus, rotates independently from the second power transmitting device.

In a preferred embodiment, the first power transmitting device is connected with the second power transmitting means. The valve driving mechanism in accordance with present invention further comprises a first phase varying device provided between the first cam shaft and the first power transmitting device for varying a relative rotation phase therebetween, and a second phase varying device between the first and second power transmitting device for varying a relative rotation phase therebetween.

In this structure, the valve timing of one of the intake valve and exhaust valve can be advanced from standard timing, and the other of the intake and exhaust valves can be retarded from the standard timing.

The above and other features of the present invention will be apparent from the following description taking reference to the accompanying drawings.

DESCRIPTION OF THE PREFERRED EMBODIMENT

Figure 1:
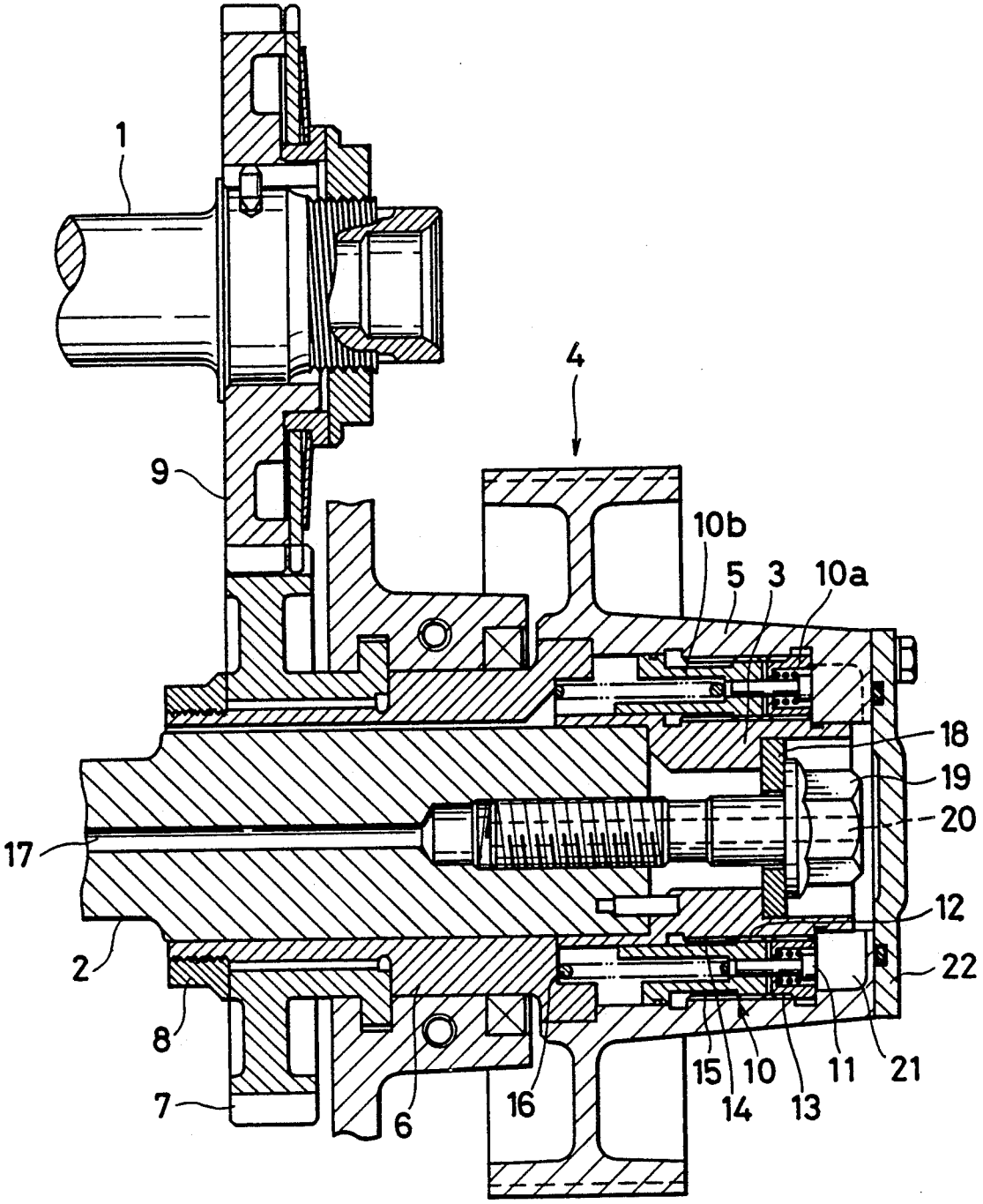
FIG. 1 is a partial and sectional view of a valve driving mechanism to which the present invention is applied.

Referring to the drawings, specifically to FIG. 1, a valve driving mechanism in accordance with the present invention is provided an intake cam shaft 1 and exhaust cam shaft 2. At one end of the cam shaft 2 is fixed a tubular spacer 3. A driving pulley 4 is mounted over the spacer 3. The driving pulley 4 is provided at one end with a tubular shaped-boss portion 5 extending along the cam shaft 2. The boss portion 5 is formed at a tip end with a reduced portion which is brought into a contact with a tip end portion of the spacer 3 fixed to the cam shaft 2. The other end of the pulley 4 is fixed to one end portion of a tubular joint member 6 which is mounted on the exhaust cam shaft 2 and extends along the cam shaft 2. The joint member 6 is allowed to make a rotative movement relative to the cam shaft 2.

Figure 2:
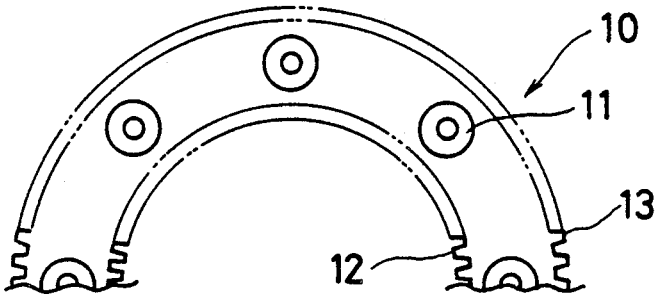
FIG. 2 is a partial end view of an annular piston.
Figure 3:
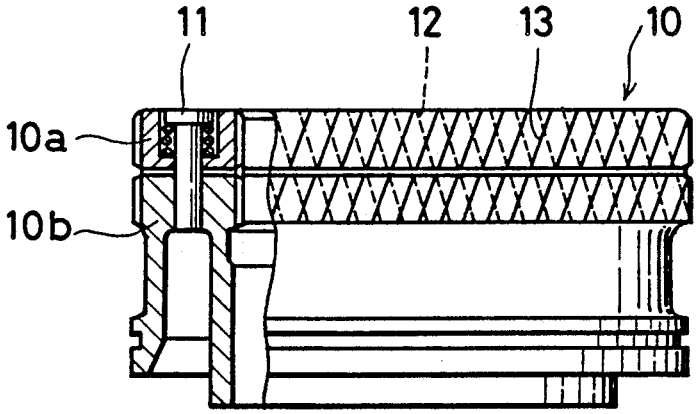
FIG. 3 is a partial sectional view showing the annular piston.
Figure 4:
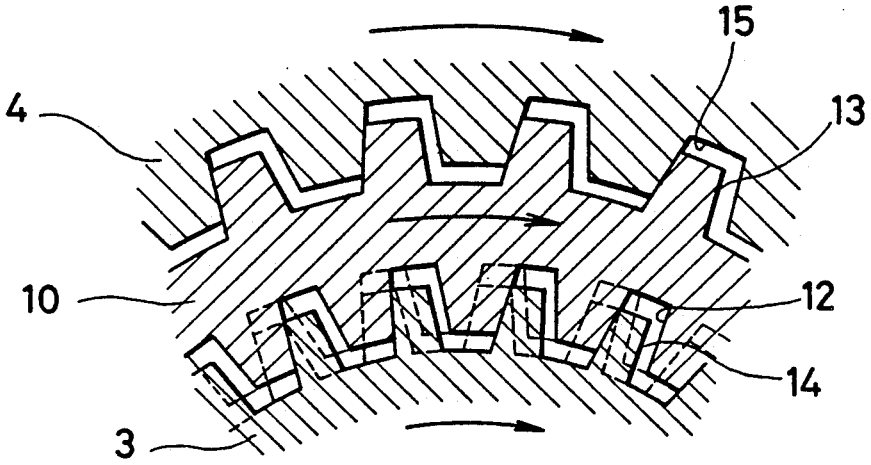
FIG. 4 is a conceptional view showing a phase change between respective members involved.

A first gear 7 is brought into a spline engagement with the other end portion of the tubular joint member 6 and fixed by a lock nut 8. The first gear 7 is meshed with a second gear 9 which is fixed at one end of the intake cam shaft 1. An annular piston device 10 extending in an axial direction of the cam shaft is incorporated between an inner surface of the boss portion 5 of the pulley 4 and the spacer 3 to cover the spacer 3. The piston device 10 is axially split into a front portion 10*a* and rear portion 10*b* which are connected with each other by a plurality of pins 11 arranged circumferentially in a spaced relationship from one another by a substantially same distance as shown in FIG. 2. The piston device 10 is provided with inner helical splines 12 on an inner surface and outer helical splines 13 on an outer surface thereof. The inner helical splines 12 is oriented in the opposite direction to the outer helical splines 13 as shown in FIG. 3. The spacer 3 is provided with helical splines 14 on an outer surface thereof so as to be engaged with the inner helical splines 12. The boss portion 5 of the pulley 4 is provided with helical splines 15 on an inner surface thereof so as to be engaged with the outer splines 13. The piston device 10 is urged toward the tip end of the cam shaft 2 by a spring 16 disposed between the piston device 10 and an end surface of the joint member 6.

An oil passage 17 is formed in the exhaust cam shaft along an axial center thereof. The tubular spacer 3 is fixed to the exhaust cam shaft 2 through a stopper 18 by means of a bolt member 19. The bolt member 19 is formed with a through-hole 20 communicating with the oil passage 17.

An end plate 22 is mounted on an end surface of the boss portion 5 of the pulley 4 to define an oil chamber 21 facing to a head portion of the piston device 10. A hydraulic pressure is introduced into the oil chamber from the oil passage 17 to control movement of the piston in accordance with an engine operating condition. For this purpose, there is provided a hydraulic control system for controlling the introduction of the hydraulic pressure into the chamber.

In operation, When the hydraulic pressure is introduced into the oil chamber 21 through the oil passage 17, the hydraulic pressure causes the piston device 10 to be moved in an axial direction of the cam shaft 2 against a resilient force of the spring 16. When the piston device 10 is moved in the axial direction of the cam shaft 2, a relative rotation between the pulley 4 and the spacer 3 is produced due to the different orientation of the inner helical splines 12 and outer helical splines 13 formed on the inner and outer surfaces of the piston device 10. This causes a change in the rotation phase between the intake cam shaft 1 and exhaust cam shaft 2 since the spacer 3 rotates together with the exhaust cam shaft 2 and the intake cam shaft 1 rotates with a stationary phase.

Figure 5:
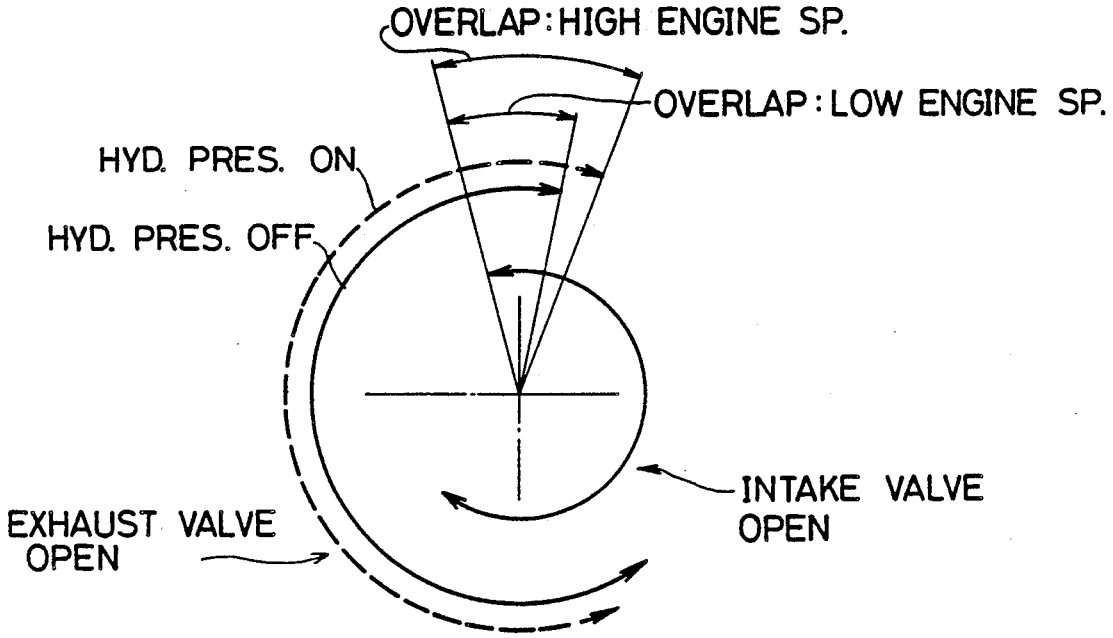
FIG. 5 and FIG. 6 are time charts showing valve timings.

In this embodiment, when the engine is in a high engine speed condition, the hydraulic pressure is introduced into the chamber 21 so that an open timing of an exhaust valve is retarded as a result of the phase change in the exhaust cam shaft 2 or a relative rotative movement against the pulley 4. Since a valve timing of an intake valve is constant, an overlap period of the opening of the intake and exhaust valves is increased in the high engine speed condition as shown in FIG. 5.

It will be understood that the valve timing varying system in accordance with the present invention is compact as aforementioned.

Figure 6:
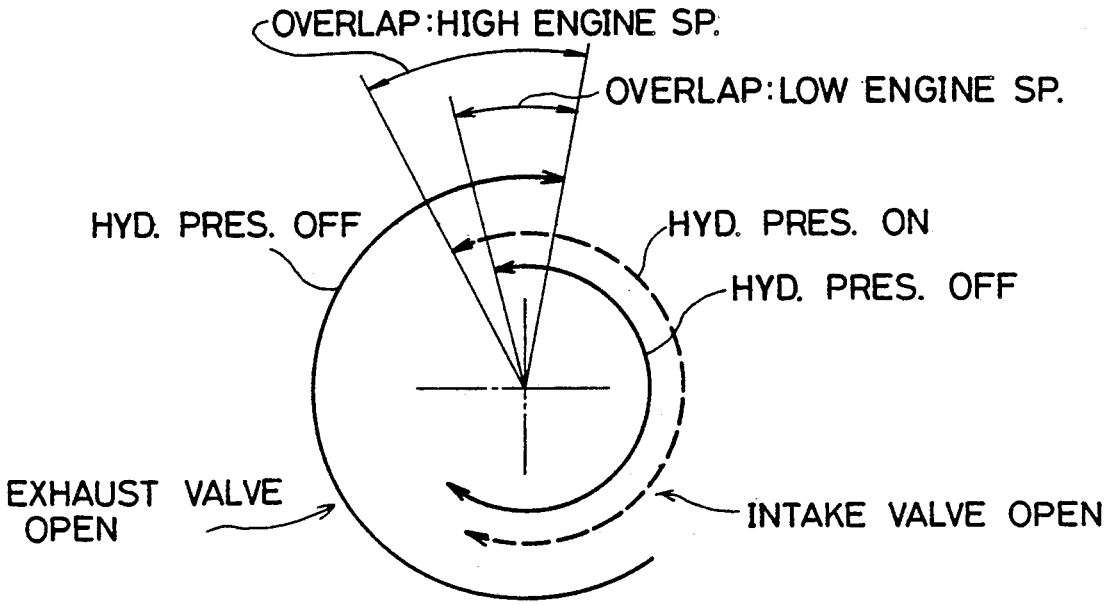

In another preferred embodiment, the piston device 10 as a valve timing varying system can be incorporated in the intake cam shaft 1. In this embodiment, the valve timing of the intake valve is advanced in the high engine speed condition as shown in FIG. 6.

Figure 7:
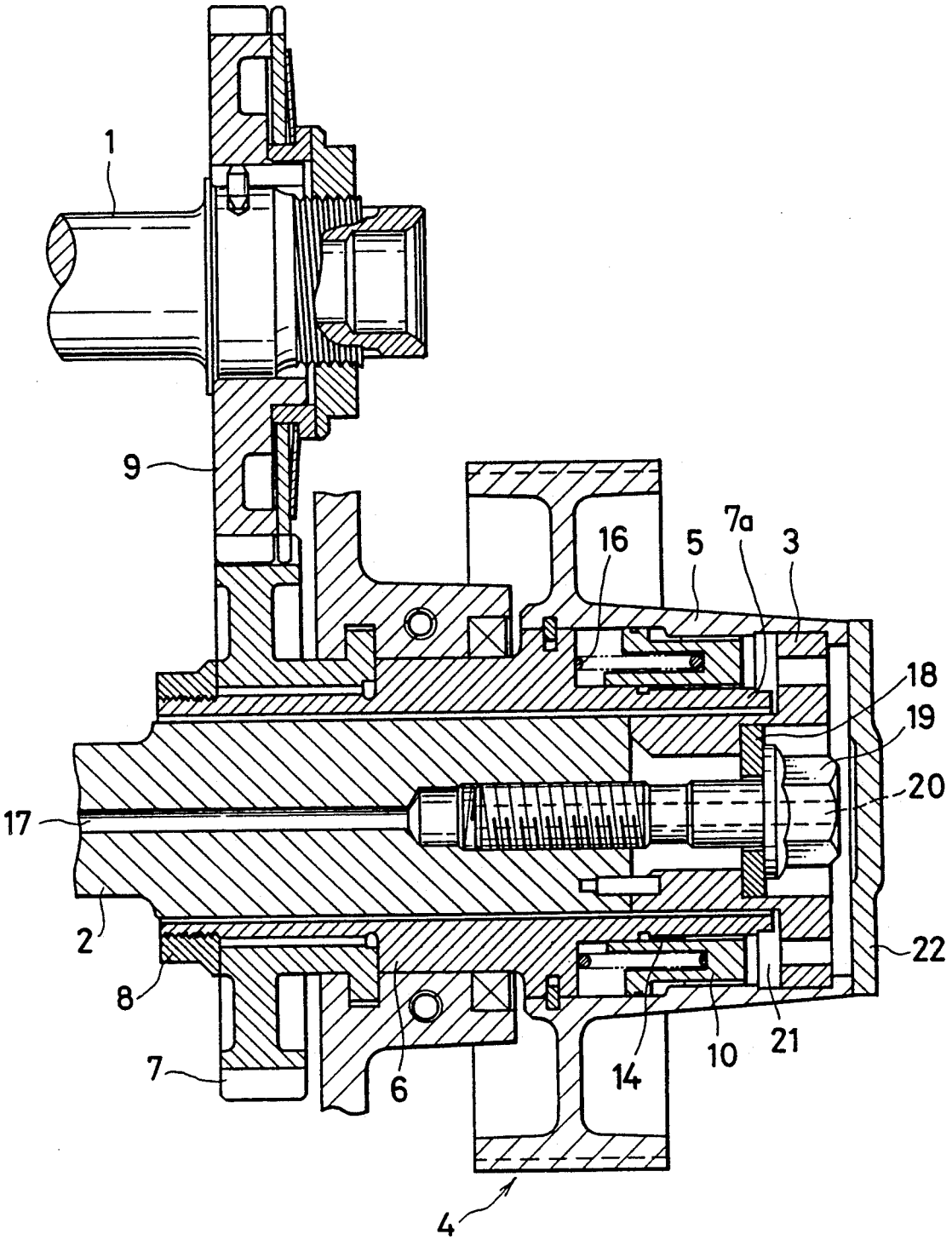
FIG. 7 is a partial and sectional view similar to FIG. 1 but showing another embodiment.
Figure 8:
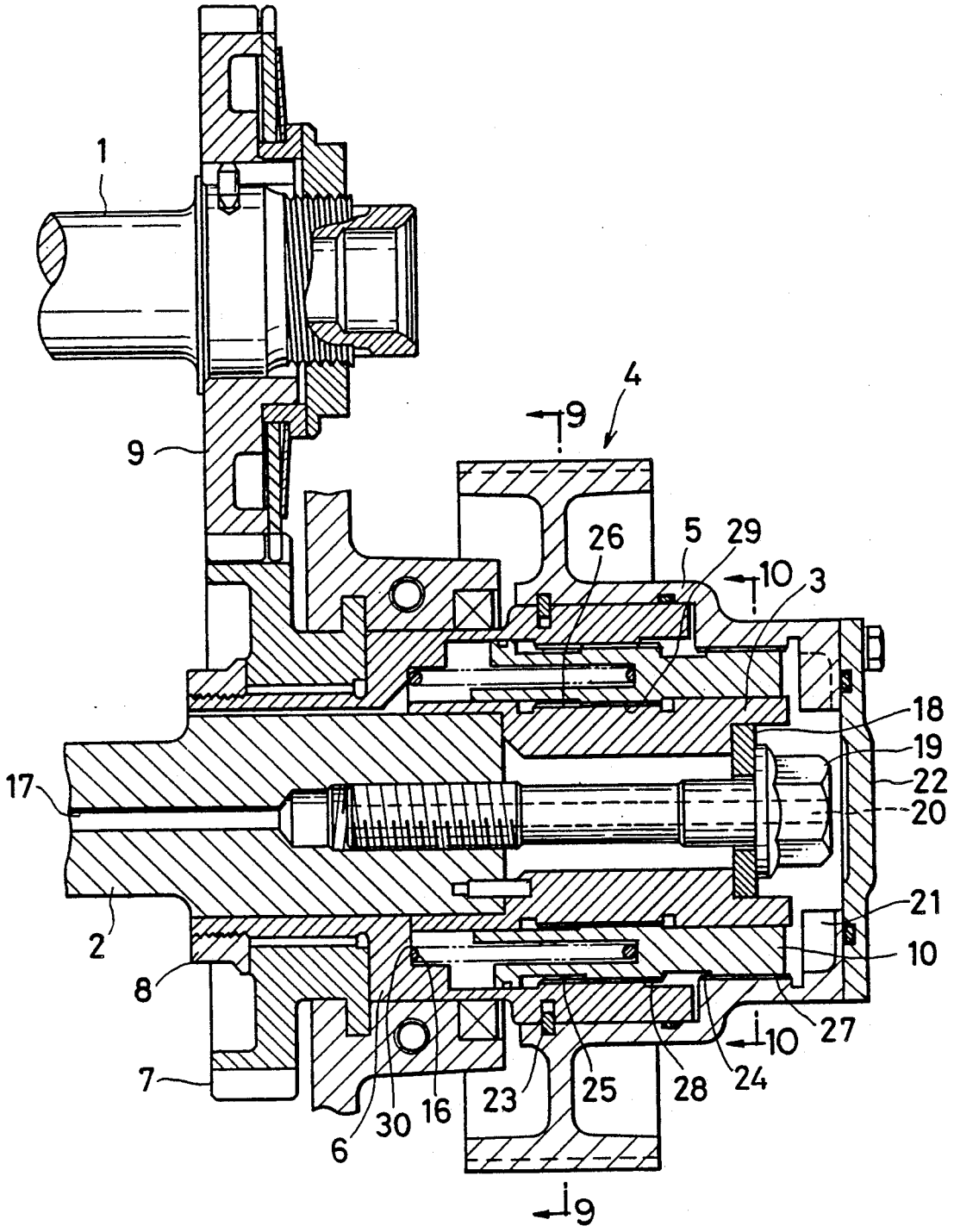
FIG. 8 is also a partial and sectional view similar to FIG. 1 but showing still another embodiment of the present invention.
Figure 9:
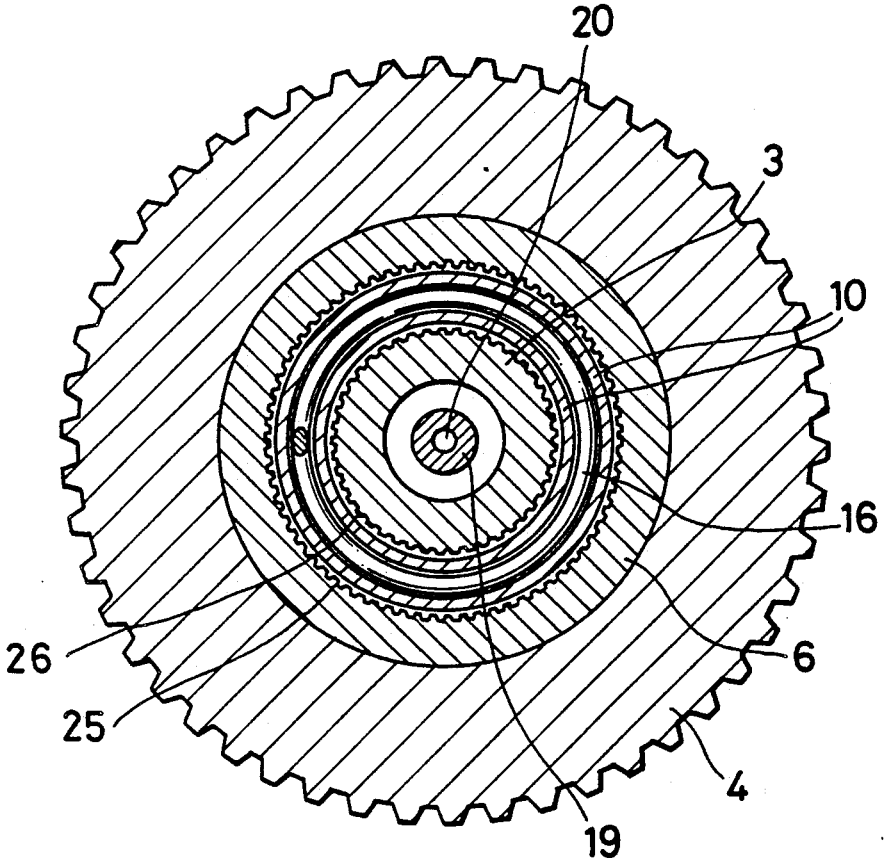
FIG. 9 is a sectional view taken from a line A-A in FIG. 8.
Figure 10:
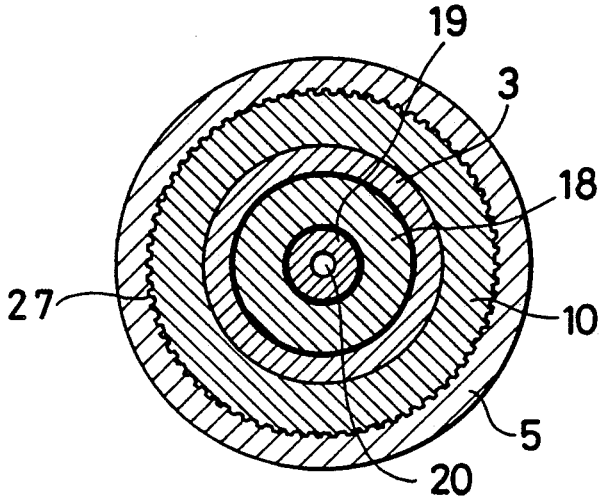
FIG. 10 is a sectional view taken from a line B-B in FIG. 8.

Referring to FIG. 7, there is shown another embodiment of the present invention. The joint member 6 of the illustrated embodiment is formed with an extension 7*a* extending toward the end plate 22. The piston device 10 is disposed between the boss portion 5 and the extension 7*a*. The extension 7*a* is formed with helical splines 14 as formed on the spacer 3 in the former embodiment on an outer surface.

The movement of the piston device 10 in the axial direction of the cam shaft 2 causes a relative rotative movement between the pulley 4 and the joint member 6 adapted to be rotated with the cam shaft 2 and the first gear 7. Thus, the same result as the former embodiment can be obtained.

Referring to FIGS. 8 through 12, still further embodiment of the present invention will be explained hereinafter.

In the illustrated embodiment, one end portion of the joint member 6 is inserted into a base portion of the pulley 4 or the boss portion 5. The valve driving mechanism is provided with a retainer ring 23 between the joint member 6 and the boss portion 5 for preventing a relative movement between the member 6 and the pulley 4 in the axial direction of the cam shaft 2. The retainer ring 23 allows a relative rotative movement between the member 6 and the pulley 4.

The other end of the joint member 6 is brought into a spline engagement with the first gear 7 and secured to each other by the lock nut 8.

An inner surface of the boss portion 5 is formed with straight splines 24. The joint member 6 is formed with helical splines 25 on an inner surface. The spacer 3 is also formed on an outer surface with helical splines 26 in an orientation opposite to that of the helical splines 25 on the joint member 6. The annular piston 10 is formed on the outer surface in an axially end portion with straight splines 27 meshing with the straight splines 24 on the inner surface of the boss portion 5, on the outer surface in an axially middle portion with helical splines 28 meshing with the helical splines 25 formed on the inner surface of the joint member 6 and on the inner surface of the middle portion with helical splines 29 meshing with the helical splines 26 formed on the outer surface of the spacer 3. The joint member 6 is formed with a stepped portion 30 defining a receiving surface for the spring 16. The annular piston 10 is urged toward right in FIG. 8. In this structure, the joint member 6 connected to the gear 7, the spacer 3 fixed to the cam shaft 2 and the boss portion 5 of the pulley 4 are connected with each other through the annular piston device 10 so as to make a relative rotative movement to one another.

Figure 11:
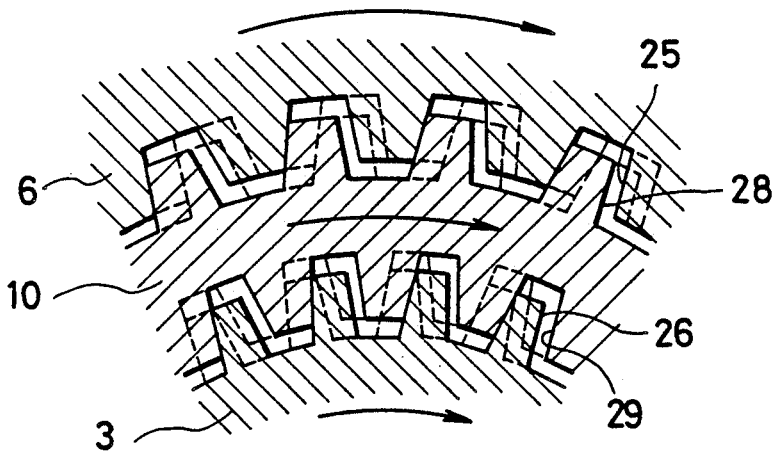
FIG. 11 is a conceptional view similar to FIG. 4 but relating to the embodiment of FIG. 8.
Figure 12:
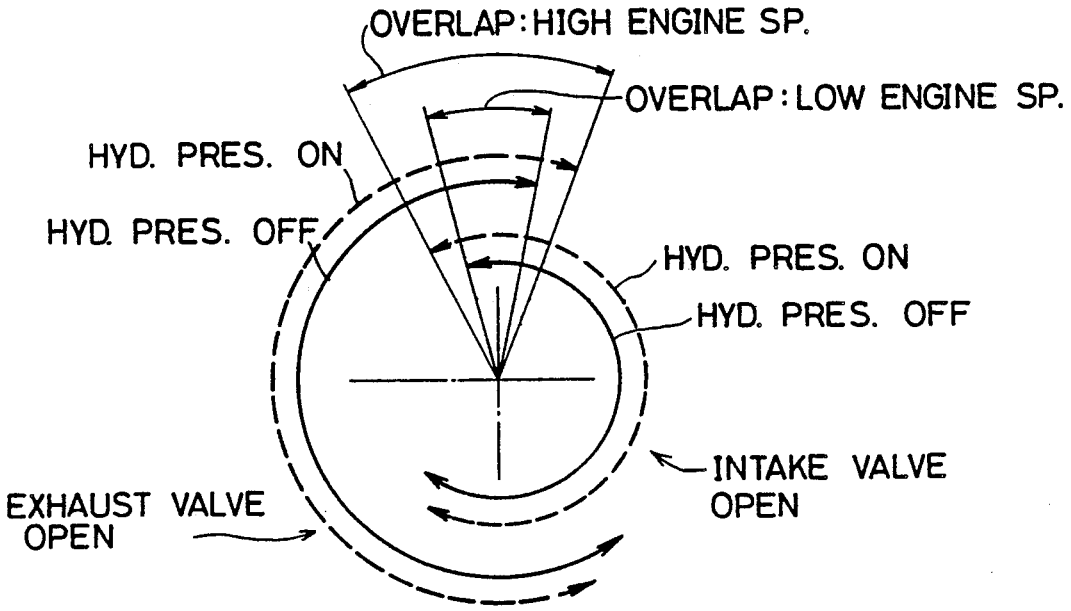
FIG. 12 is a time chart showing the valve timing with regard to the embodiment shown in FIG. 8.

In operation, when the piston 10 is moved in the axial direction due to the hydraulic pressure introduced into the chamber 24, the rotative relationship of the piston 10 to the joint member 6 and spacer 3 or the cam shaft 2 is changed due to the reverse orientation between the helical splines 28 and 29 as shown in FIG. 11. That is, the axial movement of the annular piston 10 causes a relative rotation phase change between a rotative movement of the pulley 4 to the annular piston device 10 and a rotative movement of the joint member 6 relative to the annular piston device 10 in a direction opposite to each other. Inasmuch as the intake cam shaft 1 is connected with the exhaust cam shaft 2 through the first and second gears 8 and 9, a phase change is produced in an opposite direction to the exhaust cam shaft 2. In the illustrated embodiment, the hydraulic pressure is introduced into the chamber 21 at a high engine speed condition so that the exhaust valve closing timing is retarded and the intake valve opening timing is advanced as shown in FIG. 12.

The drive pulley 4 may be provided on the intake cam shaft 1 as well.

It will be apparent that various modifications and improvements may be made based on the above descriptions by those skilled in the art without departing from the scope of the claims as attached.

We claim:

1. A valve driving mechanism comprising:

a first cam shaft for driving either an intake valve or an exhaust valve, a second cam shaft for driving the other of the intake valve and the exhaust valve, first transmitting means provided on the first cam shaft for driving said first cam shaft, second transmitting means provided on the first cam shaft for transmitting a driving power from said first transmitting means to second cam shaft, phase varying means for varying a relative rotation phase among said first cam shaft, said first transmitting means and said second transmitting means, said first cam shaft and said first and second transmitting means being connected with one another to produce a rotative phase change relative to one another through said phase varying means so that the first cam shaft is rotated in an opposite direction to the second transmitting means with regard to the first transmitting means, said first transmitting means being provided with a boss portion extending along the first cam shaft, said second transmitting means being provided with tubular joint means extending along the first cam shaft for connecting the second transmitting means to the first transmitting means while permitting a relative rotative movement between the first and second transmitting means, said joint means being permitted to make a rotative movement relative to both the boss portion and the first cam shaft, said phase varying means having an annular piston device disposed between said first cam shaft and said joint means and between said first cam shaft and the boss portion, end engaging means for engaging an end portion of said annular piston device with said boss portion, first middle engaging means for engaging a middle portion of said annular piston device with said joint means and second middle engaging means for engaging the first cam shaft with a middle portion of the annular piston device, said first middle engaging means producing a rotative movement of the joint means relative to the annular piston device due to axial movement of the annular piston device, said second middle engaging means producing a rotative movement of the first cam shaft relative to the annular piston device due to the axial movement of the annular piston device, said rotative movement between the annular piston device and the first cam shaft being produced in a reverse direction to that between the annular piston device and the joint means.

2. A valve driving mechanism as recited in claim 1 wherein said end engaging means comprises end outer straight splines formed on an outer surface of an end portion of the annular piston device and inner straight splines formed on an inner surface of the boss portion, said end outer straight splines being brought into meshing engagement with said inner straight splines without producing a relative rotative movement therebetween irrespective of the axial movement of the annular piston device, said first middle engaging means having middle outer helical splines formed on an outer surface of a middle portion of the annular piston device and inner helical splines formed on an inner surface of the joint means, said middle outer helical splines of the annular piston device being brought into meshing engagement with said inner helical splines of the joint means to produce the relative rotative movement therebetween due to the axial movement of the annular piston device, said second middle engaging means comprising middle inner helical splines formed on an inner surface of the annular piston device and outer helical splines formed on an outer surface of the first cam shaft, said middle inner helical splines being brought into meshing engaqement with said outer helical splines of the first cam shaft to produce the relative rotative movement therebetween, said middle outer helical splines being oriented in a direction opposite to that of said middle inner helical splines.

3. A valve driving mechanism as recited in claim 2 wherein said annular piston device is controlled by a hydraulic pressure to produce the axial movement.

4. A valve driving mechanism comprising:

a first cam shaft for driving either an intake valve or an exhaust valve, a second cam shaft for driving the other of the intake valve and the exhaust valve, first transmitting means provided on the first cam shaft for driving said first cam shaft, second transmitting means provided on the first cam shaft for transmitting driving power from said first transmitting means to said second cam shaft, phase varying means being provided between said first cam shaft and said first transmitting means for varying a relative rotation phase between the first cam shaft and the first transmitting means, said first and second transmitting means being connected with reach other without being permitted to make a relative rotative movement.

5. A valve driving mechanism as recited in claim 4 wherein said first transmitting means is provided with a boss portion extending along the first cam shaft, said second transmitting means being provided with tubular joint means extending along the first cam shaft for connecting the second transmitting means with the first transmitting means without permitting at least relative rotative movement between the first and second transmitting means, said joint means being permitted to make a rotative movement relative to the first cam shaft, said phase varying means being arranged between the boss portion and the first cam shaft.

6. A valve driving mechanism as recited in claim 4 wherein said phase varying means comprises an annular piston device disposed between said first cam shaft and said first transmitting means, first engaging means for engaging said annular piston device with said first transmitting means, second engaging means for engaging said annular piston device with said first cam shaft, said annular piston device being moved in an axial direction of said first cam shaft to produce a relative rotational movement between said first cam shaft and said first transmitting means.

7. A valve driving mechanism as recited in claim 6 wherein said first engaging means comprises helical splines formed on an outer surface of the annular piston device and helical splines formed on an inner surface of the first transmitting means, said helical splines of the annular piston and said helical splines of said first transmitting means being brought into meshing engagement with each other and being oriented in directions opposite to each other.

8. A valve driving mechanism as recited in claim 6 wherein said second engaging means comprises helical splines formed on an inner surface of the annular piston device and helical splines formed on an outer surface of the first cam shaft, said helical splines of the annular piston and said helical splines of said first cam shaft being brought into meshing engagement with each other and being oriented in directions opposite to each other.

9. A valve driving mechanism comprising:

a first cam shaft for driving either an intake valve or an exhaust valve, a second cam shaft for driving the other of the intake valve and the exhaust valve, first transmitting means provided on the first cam shaft for driving said first cam shaft, second transmitting means provided on the first cam shaft for transmitting driving power from said first transmitting means to said second cam shaft, phase varying means being provided between said first transmitting means and said second transmitting means to change a relative rotation phase between the first transmitting means and the second transmitting means, said first transmitting means being allowed to make a rotative movement relative to said second transmitting means, said first transmitting means being connected with said first cam shaft without being permitted to make a rotative movement relative to said first cam shaft.

10. A valve driving mechanism as recited in claim 9 wherein said phase varying means comprises an annular piston device disposed between said first and second transmitting means, first engaging means for engaging said annular piston device with said first transmitting means, second engaging means for engaging said annular piston device with said second transmitting means, said annular piston device being moved in an axial direction of said first cam shaft to produce a relative rotational movement between said first and second transmitting means.

11. A valve driving mechanism as recited in claim 10 wherein said first engaging means comprises helical splines formed on an outer surface of the annular piston device and helical splines formed on an inner surface of the first transmitting means, said helical splines of the annular piston and said helical splines of first transmitting means being brought into meshing engagement with each other and being oriented in directions opposite to each other.

12. A valve driving mechanism as recited in claim 10 wherein said second engaging means comprises helical splines formed on an inner surface of the annular piston device and helical splines formed on an outer surface of the second transmitting means, said helical splines of the annular piston and said helical splines of second transmitting means being brought into meshing engagement with each other and being oriented in directions opposite to each other.

13. A valve driving mechanism as recited in claim 9 wherein said first transmitting means is provided with a boss portion extending along the first cam shaft, said second transmitting means being provided with tubular joint means extending along the first cam shaft for connecting the second transmitting means with the first transmitting means with permitting a relative rotative movement between the first and second transmitting means, said joint means being permitted to make a rotative movement relative to the first cam shaft, said boss portion being connected with the first cam shaft without being permitted to make a rotative movement relative to the first cam shaft, said phase varying means being arranged between the boss portion and the joint means.

14. A valve driving mechanism comprising:

a first cam shaft for driving either an intake valve or an exhaust valve, a second cam shaft for driving the other of the intake valve or the exhaust valve, power transmitting means provided on said first cam shaft for transmitting driving power so as to drive said first and second cam shafts, phase varying means provided on said first cam shaft for varying a relative rotation phase between said first cam shaft and said second cam shaft, a first gear coaxially provided on the first cam shaft and constituting a part of the power transmitting means, a second gear coaxially provided on the second cam shaft so as to mesh with the first gear and thereby transmit driving power from the first cam shaft to the second cam shaft, said phase varying means allowing a relative rotation phase change between the first gear and the first cam shaft to vary the relative rotation phase between the first cam shaft and the second cam shaft.

15. A valve driving mechanism as recited in claim 14 wherein said power transmitting means comprises first transmitting means for driving said first cam shaft, second transmitting means for transmitting a driving power from said first transmitting means to said second cam shaft, said first cam shaft and said first and second transmitting means being connected with one another to produce a rotative phase change to one another through said phase varying means in a manner that the first cam shaft is rotated in an opposite direction to the second transmitting means with regard to the first transmitting means.

16. A valve driving mechanism as recited in claim 14 wherein said phase varying means comprises an annular piston device extending along said first cam shaft, engaging means for engaging said first cam shaft with said power transmitting means through said annular piston device, control means for controlling a movement of said annular piston device in an axial direction of said first cam shaft, said engaging means allowing a relative rotative phase change between said first cam shaft and said power transmitting means in accordance with said axial movement of said annular piston device.

17. A valve driving mechanism as recited in claim 16 wherein said engaging means comprises inner helical splines formed on an inner surface of said power transmitting means, outer helical splines formed on an outer surface of the annular piston device, said inner helical splines being brought into meshing engagement with said outer helical splines, said inner helical splines being oriented in an opposite direction to that of said outer helical splines.

18. A valve driving mechanism as recited in claim 16 wherein said engaging means comprises outer helical splines formed on an outer surface of said first cam shaft, inner helical splines formed on an inner surface of the annular piston device, said inner helical splines being brought into meshing engagement with said outer helical splines, said inner helical splines being oriented in an opposite direction to that of said outer helical splines.

19. A valve driving mechanism as recited in claim 16 wherein said control means comprises a hydraulic pressure introducing means for introducing a hydraulic pressure into a chamber in which said annular piston device is disposed to be moved in the axial direction in accordance engine driving condition.

* * * * *